US011946219B2

(12) United States Patent
Konda et al.

(10) Patent No.: US 11,946,219 B2
(45) Date of Patent: Apr. 2, 2024

(54) WORK MACHINE, CONTROL DEVICE, AND CONTROL METHOD

(71) Applicant: KOMATSU LTD., Tokyo (JP)

(72) Inventors: Tomoki Konda, Tokyo (JP); Takeshi Oi, Tokyo (JP); Atsunori Kikuchi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 529 days.

(21) Appl. No.: 17/269,116

(22) PCT Filed: Aug. 28, 2019

(86) PCT No.: PCT/JP2019/033701
§ 371 (c)(1),
(2) Date: Feb. 17, 2021

(87) PCT Pub. No.: WO2020/054421
PCT Pub. Date: Mar. 19, 2020

(65) Prior Publication Data

US 2021/0246627 A1 Aug. 12, 2021

(30) Foreign Application Priority Data

Sep. 12, 2018 (JP) ..... 2018-170890

(51) Int. Cl.
*E02F 3/43* (2006.01)
*E02F 3/65* (2006.01)

(52) U.S. Cl.
CPC ..... *E02F 3/437* (2013.01); *E02F 3/651* (2013.01)

(58) Field of Classification Search
CPC . E02F 3/437; E02F 3/651; E02F 9/262; E02F 9/265
See application file for complete search history.

(56) References Cited

U.S. PATENT DOCUMENTS 6,247,538 B1 6/2001 Takeda et al.
9,752,298 B2 * 9/2017 Nakamura ..... E02F 9/265
2014/0100712 A1 4/2014 Nomura et al.
(Continued)

FOREIGN PATENT DOCUMENTS

CN 107709673 A 2/2018
EP 3 399 111 A1 11/2018
(Continued)

OTHER PUBLICATIONS

The International Search Report for the corresponding international application No. PCT/JP2019/033701, dated Nov. 26, 2019.

*Primary Examiner* — Tyler J Lee
*Assistant Examiner* — Yufeng Zhang
(74) *Attorney, Agent, or Firm* — Global IP Counselors, LLP

(57) ABSTRACT

A work machine includes work equipment. A control device of the work machine includes a trajectory generation unit, and an operation signal output unit. The trajectory generation unit generates a target trajectory of the work equipment according to an excavation curve ratio determined in advance. The excavation curve ratio is expressed as a ratio of an excavation depth to an excavation length. The operation signal output unit outputs an operation signal for the work equipment according to the target trajectory.

13 Claims, 5 Drawing Sheets

(56) References Cited

U.S. PATENT DOCUMENTS

| | | | |
|---|---|---|---|
| 2016/0258128 | A1 | 9/2016 | Nakamura et al. |
| 2019/0003152 | A1 | 1/2019 | Nakamura et al. |

FOREIGN PATENT DOCUMENTS

| | | | |
|---|---|---|---|
| JP | 61-87033 | A | 5/1986 |
| JP | 6-313327 | A | 11/1994 |
| JP | 7-158104 | A | 6/1995 |
| JP | 10-245865 | A | 9/1998 |
| WO | 2014/054194 | A1 | 4/2014 |
| WO | 2017/115810 | A1 | 7/2017 |

* cited by examiner

WORK MACHINE, CONTROL DEVICE, AND CONTROL METHOD

CROSS-REFERENCE TO RELATED APPLICATIONS

This application is a U.S. National stage application of International Application No. PCT/JP2019/033701, filed on Aug. 28, 2019. This U.S. National stage application claims priority under 35 U.S.C. § 119(a) to Japanese Patent Application No. 2018-170890, filed in Japan on Sep. 12, 2018, the entire contents of which are hereby incorporated herein by reference.

BACKGROUND

Field of the Invention

The present invention relates to a work machine including work equipment, and a control device and a control method for the work machine.

Background Information

Japanese Unexamined Patent Application, First Publication No. S61-87033 discloses a technique of automatically controlling work equipment to draw an excavation trajectory similar to the past excavation trajectory created by an operation of an operator.

SUMMARY

In excavation work, as the excavation depth is deep, the resistance applied to the work equipment becomes larger and the excavation speed of the work equipment becomes slower. As the excavation length is longer, the movement distance of the work equipment becomes longer and the excavation time becomes longer. When the same amount of earth is attempted to be excavated, the excavation length becomes longer as the excavation depth is shallower, and the excavation depth becomes deeper as the excavation length is shorter. Namely, the excavation depth and the excavation length are in a trade-off relationship in excavation efficiency.

As described in Japanese Unexamined Patent Application, First Publication No. S61-87033, when automatic control of the work equipment is performed according to the excavation trajectory created by an operation of the operator, excavation efficiency in the automatic excavation differs depending on the skill of the operator.

An object of the present invention is to provide a work machine, a control device, and a control method capable of performing an automatic excavation process with a certain excavation efficiency or more regardless of the skill of an operator.

According to one aspect of the present invention, a control device of a work machine includes a work equipment, the control device includes: a trajectory generation unit that generates a target trajectory of the work equipment according to an excavation curve ratio determined in advance, the excavation curve ratio expressed as a ratio of an excavation depth to an excavation length; and an operation signal output unit that outputs an operation signal for the work equipment according to the target trajectory.

According to at least one of the above aspects, the control device of the work machine can perform an automatic excavation process with a certain excavation efficiency or more.

DETAILED DESCRIPTION OF EMBODIMENT(S)

Hereinafter, embodiments will be described in detail with reference to the drawings.

First Embodiment (Configuration of Loading Machine)

Figure 1:
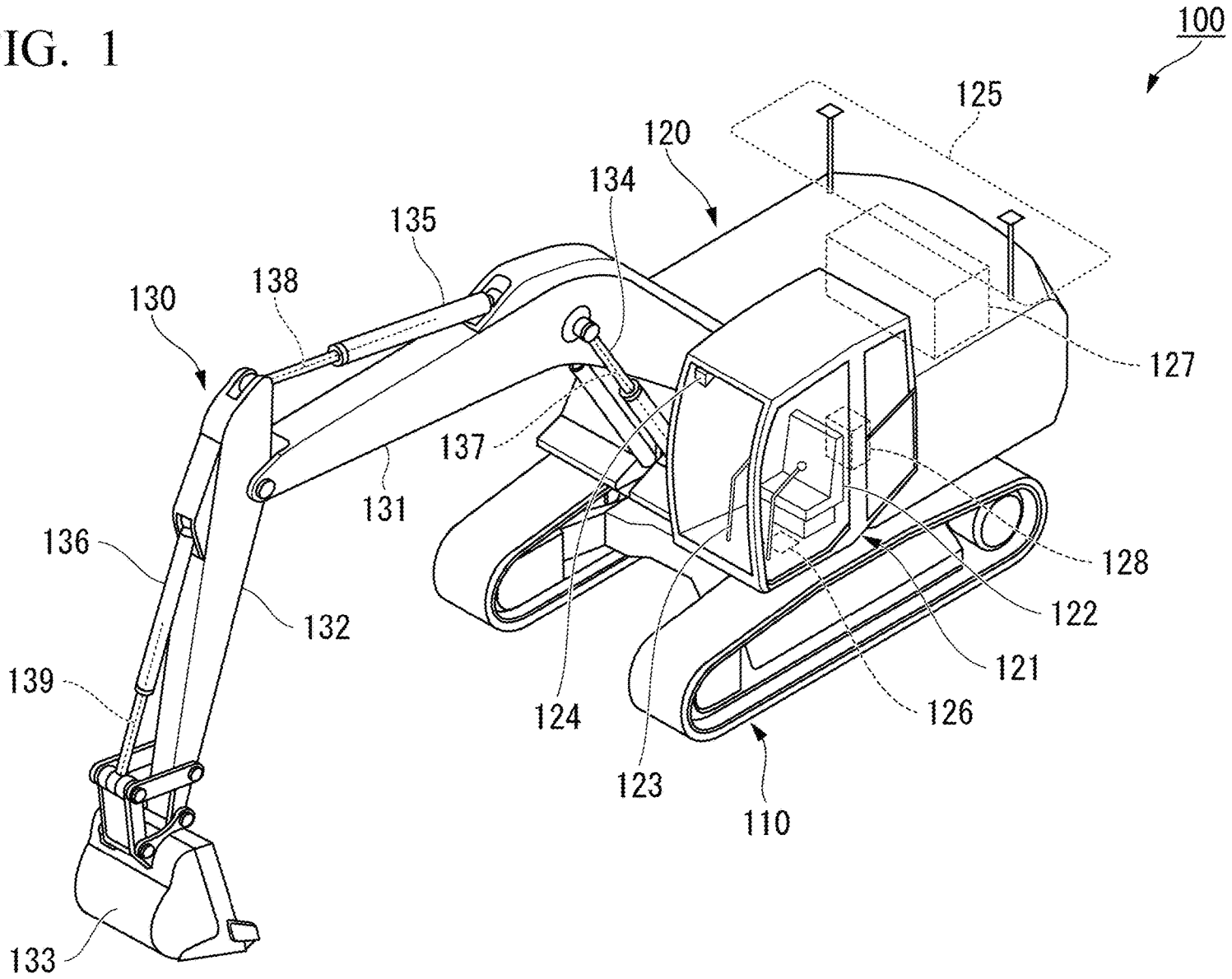
FIG. 1 is a schematic view illustrating a configuration of a loading machine according to a first embodiment.

FIG. 1 is a schematic view illustrating a configuration of a loading machine according to a first embodiment.

A loading machine 100 is a work machine that excavates an excavation target such as earth. The loading machine 100 according to the first embodiment is a hydraulic excavator. Incidentally, the loading machine 100 according to another embodiment may be a loading machine other than the hydraulic excavator. In addition, the loading machine 100 illustrated in FIG. 1 is a backhoe excavator, but may be a face excavator or a rope excavator.

The loading machine 100 includes a carriage 110, a swing body 120 supported by the carriage 110, and work equipment 130 that is operated by hydraulic pressure and is supported by the swing body 120. The swing body 120 is supported so as to be swingable around the center of swing.

The work equipment 130 includes a boom 131, an arm 132, a bucket 133, a boom cylinder 134, an arm cylinder 135, a bucket cylinder 136, a boom cylinder sensor 137, an arm cylinder sensor 138, and a bucket cylinder sensor 139.

A proximal end portion of the boom 131 is attached to the swing body 120 via a pin.

The arm 132 connects the boom 131 and the bucket 133. A proximal end portion of the arm 132 is attached to a distal end portion of the boom 131 via a pin.

The bucket 133 includes a blade that excavates the excavation target and a container that contains the excavated excavation target. A proximal end portion of the bucket 133 is attached to a distal end portion of the arm 132 via a pin.

The boom cylinder 134 is a hydraulic cylinder that operates the boom 131. A proximal end portion of the boom cylinder 134 is attached to the swing body 120. A distal end portion of the boom cylinder 134 is attached to the boom 131.

The arm cylinder 135 is a hydraulic cylinder that drives the arm 132. A proximal end portion of the arm cylinder 135 is attached to the boom 131. A distal end portion of the arm cylinder 135 is attached to the arm 132.

The bucket cylinder 136 is a hydraulic cylinder that drives the bucket 133. A proximal end portion of the bucket cylinder 136 is attached to the arm 132. A distal end portion of the bucket cylinder 136 is attached to a link mechanism that rotates the bucket 133.

The boom cylinder sensor 137 measures the stroke amount of the boom cylinder 134. The stroke amount of the boom cylinder 134 can be converted into the inclination angle of the boom 131 with respect to the swing body 120. Hereinafter, the inclination angle with respect to the swing body 120 is also referred to as an absolute angle. Namely, the stroke amount of the boom cylinder 134 can be converted into the absolute angle of the boom 131.

The arm cylinder sensor 138 measures the stroke amount of the arm cylinder 135. The stroke amount of the arm cylinder 135 can be converted into the inclination angle of the arm 132 with respect to the boom 131. Hereinafter, the inclination angle of the arm 132 with respect to the boom 131 is also referred to as a relative angle of the arm 132.

The bucket cylinder sensor 139 measures the stroke amount of the bucket cylinder 136. The stroke amount of the bucket cylinder 136 can be converted into the inclination angle of the bucket 133 with respect to the arm 132. Hereinafter, the inclination angle of the bucket 133 with respect to the arm 132 is also referred to as a relative angle of the bucket 133.

The loading machine 100 according to another embodiment may include angle sensors that detect an inclination angle with respect to the ground surface or an inclination angle with respect to the swing body 120, instead of the boom cylinder sensor 137, the arm cylinder sensor 138, and the bucket cylinder sensor 139.

A cab 121 is provided in the swing body 120. An operator seat 122 in which an operator sits, an operation device 123 that operates the loading machine 100, and a detection device 124 that detects the three-dimensional position of an object existing in a detection direction are provided inside the cab 121. The operation device 123 generates a raising operation signal and a lowering operation signal for the boom 131, a push operation signal and a pull operation signal for the arm 132, a dump operation signal and an excavation operation signal for the bucket 133, and rightward and leftward swing operation signals for the swing body 120 in response to an operation of the operator, to output the generated signals to a control device 128. In addition, the operation device 123 generates an automatic excavation instruction signal to cause the work equipment 130 to start automatic excavation control in response to an operation of the operator and outputs the generated automatic excavation instruction signal to the control device 128. The automatic excavation control is control that causes automatic execution of an operation where the boom 131, the arm 132, and the bucket 133 are driven from a state where the teeth of the bucket 133 is disposed at an excavation start position on the excavation target, to excavate the earth. The operation device 123 includes, for example, a lever, a switch and a pedal. The automatic excavation instruction signal is generated by operating a switch for automatic excavation control. For example, when the switch is turned on, the automatic excavation instruction signal is output. The operation device 123 is disposed in the vicinity of the operator seat 122. The operation device 123 is located within a range where the operator can operate the operation device 123 when the operator sits in the operator seat 122.

The detection device 124 is, for example, a stereo camera, a laser scanner, and the like. The detection device 124 is provided, for example, such that the detection direction thereof faces the front of the cab 121 of the loading machine 100. The detection device 124 specifies the three-dimensional position of an object in a coordinate system with respect to the position of the detection device 124.

Incidentally, the loading machine 100 according to the first embodiment takes a motion according to an operation of the operator sitting in the operator seat 122, but is not limited thereto in another embodiment. For example, the loading machine 100 according to another embodiment may operate by receiving an operation signal or an automatic excavation instruction signal, which is transmitted by a remote operation of the operator performing operation outside the loading machine 100.

The loading machine 100 includes a position and azimuth direction calculator 125, an inclination measurement instrument 126, a hydraulic device 127, and the control device 128.

The position and azimuth direction calculator 125 calculates the position of the swing body 120 and the azimuth direction in which the swing body 120 faces. The position and azimuth direction calculator 125 includes two receivers that receive positioning signals from artificial satellites forming the GNSS. The two receivers are installed at different positions on the swing body 120. The position and azimuth direction calculator 125 detects the position of a representative point of the swing body 120 in a site coordinate system (origin of an excavator coordinate system) based on the positioning signals received by the receivers.

The position and azimuth direction calculator 125 uses the positioning signals, which are received by the two receivers, to calculate the azimuth direction of the swing body 120 as a relationship between the installation position of one receiver and the installation position of the other receiver. The azimuth direction of the swing body 120 is the front direction of the swing body 120 and is equal to a horizontal component of the extending direction of a straight line extending from the boom 131 to the bucket 133 of the work equipment 130.

The inclination measurement instrument 126 measures the acceleration and angular speed of the swing body 120 to detect the posture (for example, the roll angle and the pitch angle) of the swing body 120 based on a measurement result. The inclination measurement instrument 126 is installed, for example, on a lower surface of the swing body 120. For example, an inertial measurement unit (IMU) can be used as the inclination measurement instrument 126.

The hydraulic device 127 includes a hydraulic oil tank, a hydraulic pump, and a flow rate control valve. The hydraulic pump is driven by power of an engine (unillustrated) to supply a hydraulic oil to a carriage hydraulic motor (unillustrated) that causes the carriage 110 to perform carriage, a swing hydraulic motor (unillustrated) that swings the swing body 120, the boom cylinder 134, the arm cylinder 135, and the bucket cylinder 136 via the flow rate control valve. The flow rate control valve includes a spool having a rod shape and adjusts the flow rate of the hydraulic oil to be supplied to the carriage hydraulic motor, the swing hydraulic motor, the boom cylinder 134, the arm cylinder 135, and the bucket cylinder 136 based on a position of the spool. The spool is driven according to a control command received from the control device 128. Namely, the amount of the hydraulic oil to be supplied to the carriage hydraulic motor, the swing hydraulic motor, the boom cylinder 134, the arm cylinder 135, and the bucket cylinder 136 is controlled by the control device 128. As described above, the carriage hydraulic motor, the swing hydraulic motor, the boom cylinder 134, the arm cylinder 135, and the bucket cylinder 136 are driven by the hydraulic oil supplied from the hydraulic device 127 that is common. Incidentally, when the carriage hydraulic motor or the swing hydraulic motor is a swash plate type variable displacement motor, the control device 128 may control the inclination angle of a swash plate to adjust the rotational speed.

The control device 128 receives an operation signal from the operation device 123. The control device 128 drives the work equipment 130, the swing body 120, or the carriage 110 based on the received operation signal.

(Configuration of Control Device)

Figure 2:
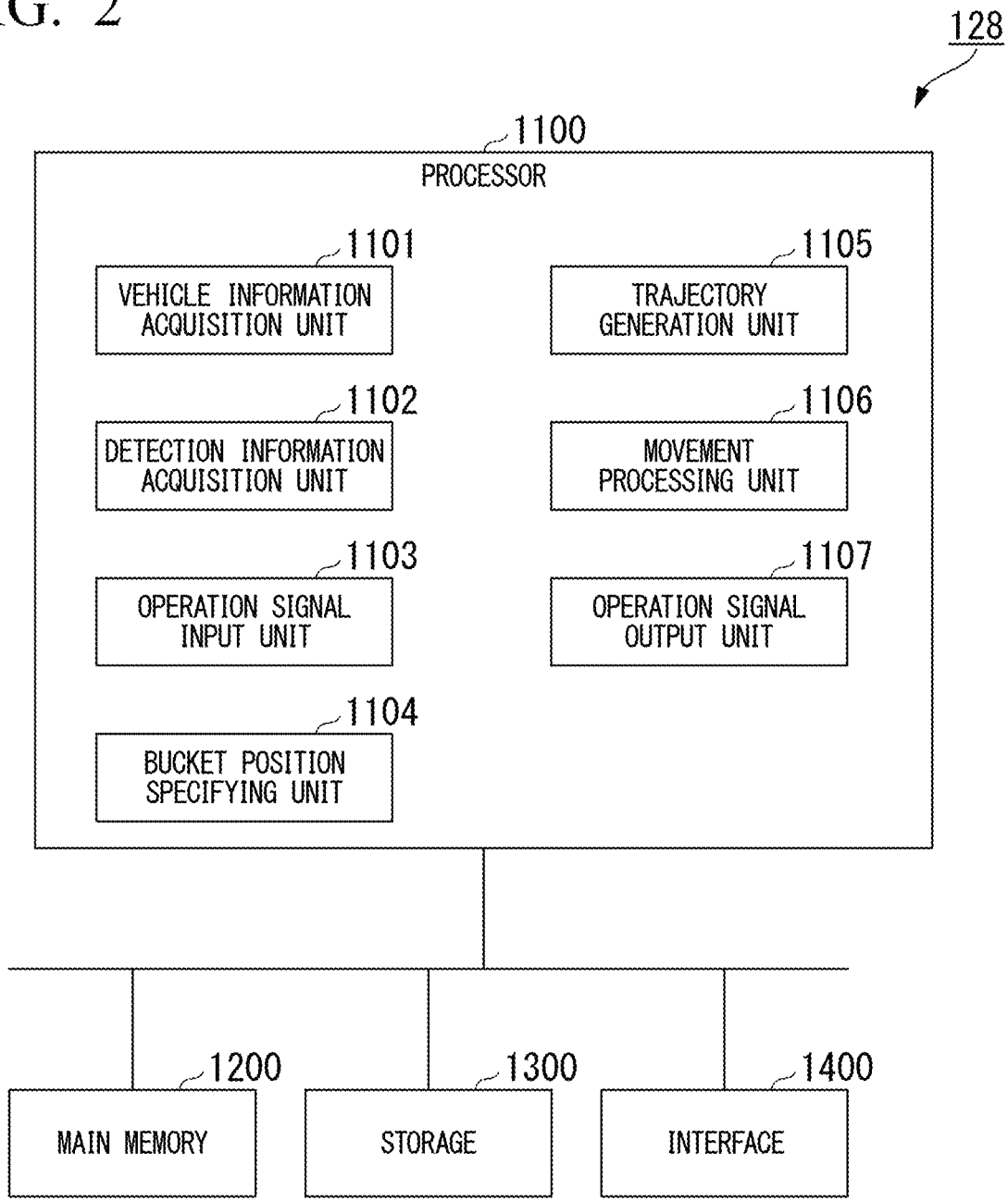
FIG. 2 is a schematic block diagram illustrating a configuration of a control device according to the first embodiment.

FIG. 2 is a schematic block diagram illustrating a configuration of the control device according to the first embodiment.

The control device 128 is a computer including a processor 1100, a main memory 1200, a storage 1300, and an interface 1400. The storage 1300 stores a program. The processor 1100 reads the program from the storage 1300 to deploy the program in the main memory 1200 and to then execute a process according to the program.

The storage 1300 is, for example, a HDD, a SSD, a magnetic disk, a magneto-optical disk, a CD-ROM, a DVD-ROM and the like. The storage 1300 may be an internal medium directly connected to a common communication line of the control device 128, or may be an external medium connected to the control device 128 via the interface 1400. The storage 1300 is anon-transitory type storage medium.

The processor 1100 executes the program and includes a vehicle information acquisition unit 1101, a detection information acquisition unit 1102, an operation signal input unit 1103, a bucket position specifying unit 1104, a trajectory generation unit 1105, a movement processing unit 1106, and an operation signal output unit 1107.

The vehicle information acquisition unit 1101 acquires, for example, the swing speed, position, and azimuth direction of the swing body 120, the inclination angles of the boom 131, the arm 132, and the bucket 133, and the posture of the swing body 120.

The detection information acquisition unit 1102 acquires three-dimensional position information from the detection device 124 to specify the position and shape of the excavation target. The detection information acquisition unit 1102 is one example of a shape acquisition unit.

The operation signal input unit 1103 receives an input of an operation signal from the operation device 123. The operation signal includes a raising operation signal and a lowering operation signal for the boom 131, a push operation signal and a pull operation signal for the arm 132, a dump operation signal and an excavation operation signal for the bucket 133, a swing operation signal for the swing body 120, a carriage operation signal for the carriage 110, and an automatic excavation instruction signal for the loading machine 100.

The bucket position specifying unit 1104 specifies the position of the teeth of the bucket 133 in the excavator coordinate system based on the vehicle information acquired by the vehicle information acquisition unit 1101.

Specifically, the bucket position specifying unit 1104 specifies the position of the teeth of the bucket 133 according to the following procedure. The bucket position specifying unit 1104 obtains the position of the distal end portion of the boom 131 based on the absolute angle of the boom 131 obtained from the stroke amount of the boom cylinder 134 and the known length of the boom 131 (distance from the pin of the proximal end portion to the pin of the distal end portion). The bucket position specifying unit 1104 obtains the absolute angle of the arm 132 based on the absolute angle of the boom 131 and the relative angle of the arm 132 obtained from the stroke amount of the arm cylinder 135. The bucket position specifying unit 1104 obtains the position of the distal end portion of the arm 132 based on the position of the distal end portion of the boom 131, the absolute angle of the arm 132, and the known length of the arm 132 (distance from the pin of the proximal end portion to the pin of the distal end portion). The bucket position specifying unit 1104 obtains the absolute angle of the bucket 133 based on the absolute angle of the arm 132 and the relative angle of the bucket 133 obtained from the stroke amount of the bucket cylinder 136. The bucket position specifying unit 1104 obtains the position of the teeth of the bucket 133 based on the position of the distal end portion of the arm 132, the absolute angle of the bucket 133, and the known length of the bucket 133 (distance from the pin of the proximal end portion to the teeth).

Figure 3:
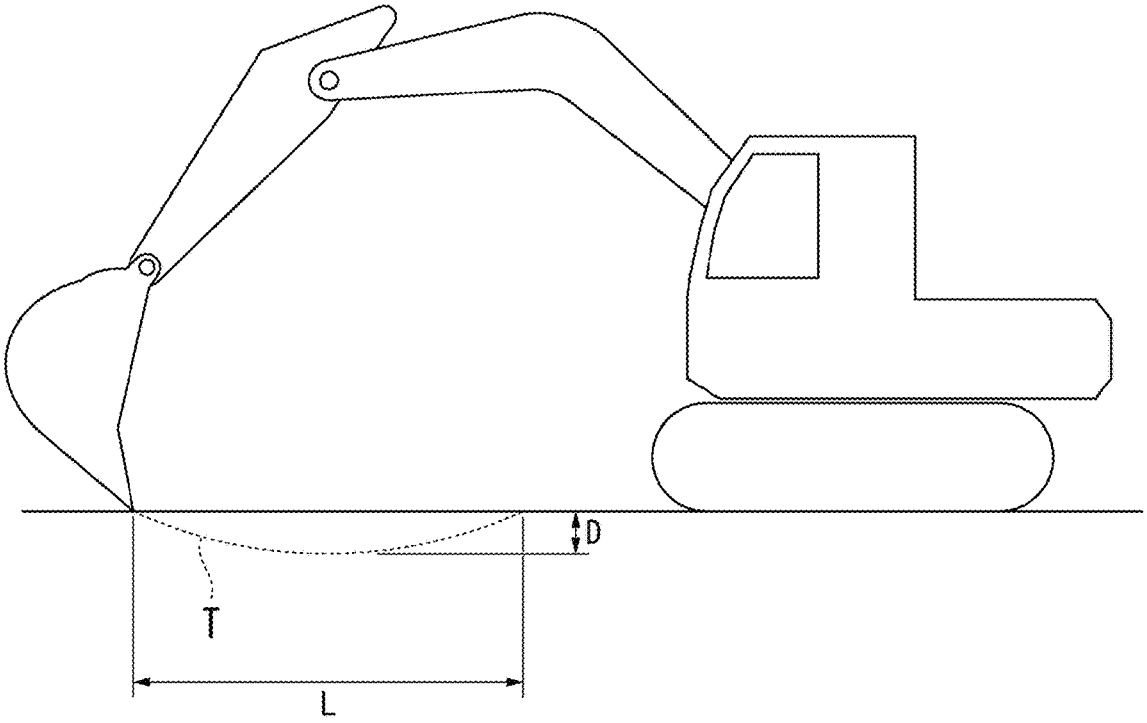
FIG. 3 is a view illustrating an example of a target trajectory.

The trajectory generation unit 1105 generates a target trajectory T of the bucket 133 based on the position of the teeth of the bucket 133 specified by the bucket position specifying unit 1104 when the automatic excavation instruction signal is input and the detection information acquired by the detection information acquisition unit 1102. FIG. 3 is a view illustrating an example of the target trajectory. The target trajectory T of the bucket 133 is drawn as the trajectory of the teeth in which the excavation target is excavated in an excavation direction from the position of the teeth of the bucket 133 when the automatic excavation instruction signal is input. In the backhoe excavator, the excavation direction is a rearward direction of the swing body 120. The shape of the target trajectory T according to the first embodiment is a circular arc. As illustrated in FIG. 3, the target trajectory T of the bucket 133 draws an arc according to an excavation curve ratio determined in advance. The excavation curve ratio is a value expressed as the ratio of an excavation depth D to an excavation length L (D/L). The smaller the excavation curve ratio is, the longer the excavation length L is and the shallower the excavation depth D is. The larger the excavation curve ratio is, the shorter the excavation length L is and the deeper the excavation depth D is. A method for specifying the excavation curve ratio will be described later. The trajectory generation unit 1105 calculates an excavation amount when excavation is performed according to the target trajectory T generated and generates the target trajectory T of the bucket 133 such that the excavation amount is equal to the maximum capacity of the bucket 133. Incidentally, the shape of the target trajectory T according to another embodiment may be any curve having a shape protruding downward, such as an elliptical arc, a parabola, or a gentle curve having no inflection point.

The movement processing unit 1106 generates an operation signal to cause the teeth of the bucket 133 to move along the target trajectory T when the operation signal input unit 1103 receives an input of the automatic excavation instruction signal.

The operation signal output unit 1107 outputs the operation signal input to the operation signal input unit 1103 or the operation signal generated by the movement processing unit 1106. Specifically, the operation signal output unit 1107 outputs the operation signal generated by the movement processing unit 1106 when the automatic excavation control is in progress and outputs the operation signal input to the operation signal input unit 1103 when the automatic excavation control is not in progress.

(Excavation Curve Ratio)

The excavation curve ratio of the target trajectory generated by the trajectory generation unit 1105 is a value obtained in advance such that excavation can be performed with a certain excavation efficiency or more. The excavation efficiency is obtained by dividing the amount of excavated earth by the excavation time. Namely, when a certain amount of earth is excavated, as the excavation efficiency is high, the excavation time becomes shorter.

Figure 4:
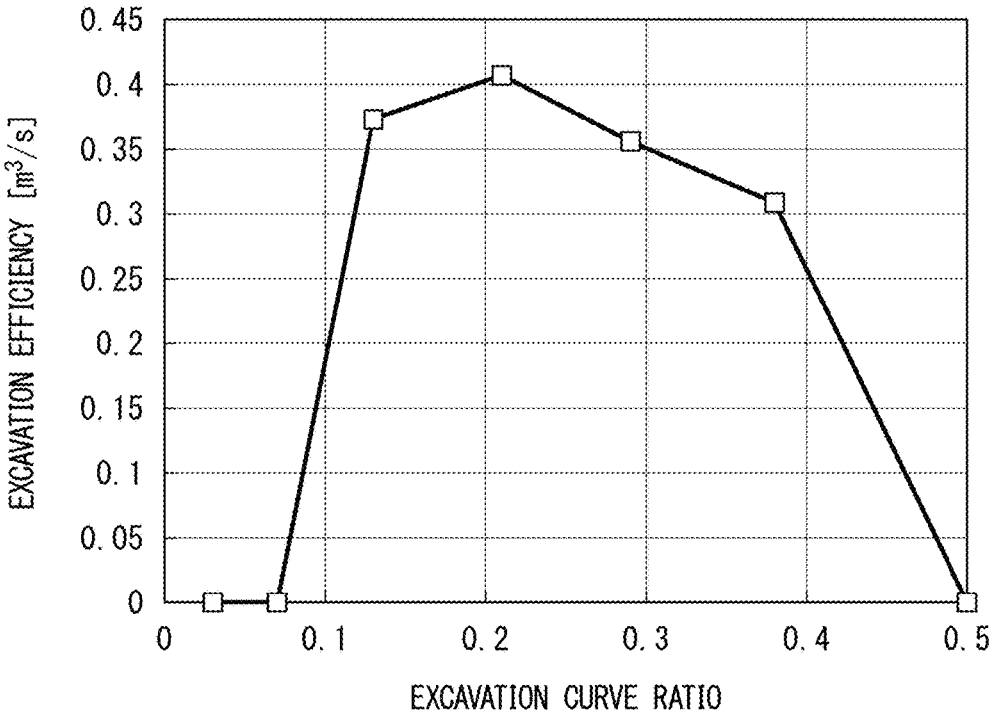
FIG. 4 is a graph illustrating a relationship between the excavation curve ratio and the excavation efficiency.

FIG. 4 is a graph illustrating a relationship between the excavation curve ratio and the excavation efficiency. FIG. 4 illustrates the excavation efficiency when a simulation of excavation is performed based on physical models of the work machine and the excavation target. The simulation illustrated in FIG. 4 is performed based on the assumption that a certain amount of earth is excavated under the condition that the relative angle of the arm 132 at the start of excavation is 110 degrees and the excavation target is earth distributed in a planar shape.

As illustrated in FIG. 4, it can be seen that when the excavation curve ratio is less than 0.10, the excavation efficiency decreases rapidly and the excavation efficiency becomes 0.00. When the excavation curve ratio is less than 0.10, since the excavation depth D is shallow, the excavation length is long. For this reason, when a certain amount of earth is attempted to be excavated, the target trajectory T comes into contact with the carriage 110 of the loading machine 100 or enters the outside of the movable range of the work equipment 130, so that excavation cannot be physically performed. Namely, an excavation efficiency of 0.00 indicates that a certain amount of earth cannot be excavated.

As illustrated in FIG. 4, it can be seen that when the excavation curve ratio is larger than 0.40, the excavation efficiency decreases rapidly, and when the excavation curve ratio is 0.5, the excavation efficiency becomes 0.00. When the excavation curve ratio is larger than 0.40, since the excavation depth D is deep, the load applied to the bucket 133 during excavation is increased. In addition, when excavation is performed with the bucket 133, the angle of the bucket 133 with respect to a traveling direction of the teeth of the bucket is required to be properly maintained. When the excavation curve ratio exceeds 0.4, excavation is required to be performed in a state where a bottom surface of the bucket 133 is inclined substantially vertically or more in a dump direction, but the inclination angle of the bucket 133 at this time exceeds the movable range of the bucket 133 with respect to the arm 132, so that the angle of the bucket 133 cannot be properly maintained. For this reason, hydraulic pressure supplied to the work equipment 130 exceeds a relief pressure, so that the hydraulic oil is released by a relief valve (unillustrated) provided in the hydraulic device 127. Since the excavation efficiency deteriorates as the amount of the hydraulic oil relieved is increased, as the excavation depth D is deep, namely, as the excavation curve ratio is low, the excavation efficiency becomes worse.

As illustrated in FIG. 4, when the excavation curve ratio is from 0.10 to 0.40, the excavation efficiency is a value exceeding 0.2. For this reason, the trajectory generation unit 1105 generates the target trajectory T having an excavation curve ratio of 0.10 to 0.40, so that automatic excavation can be performed with a certain excavation efficiency or more. In addition, as illustrated in FIG. 4, when the excavation curve ratio is from 0.12 to 0.30, the excavation efficiency is a value exceeding 0.35. For this reason, the trajectory generation unit 1105 generates the target trajectory T having an excavation curve ratio of 0.12 to 0.30, so that automatic excavation can be more efficiently performed. In addition, as illustrated in FIG. 4, it can be seen that when the excavation curve ratio is 0.20, automatic excavation is performed with the best excavation efficiency. Therefore, it is desirable that the trajectory generation unit 1105 according to the first embodiment generates the target trajectory T such that the excavation curve ratio is 0.20. In addition, as illustrated in FIG. 4, even when the excavation curve ratio is from 0.15 to 0.25, excavation can be performed with substantially the same excavation efficiency as when the excavation curve ratio is 0.20.

Figure 5:
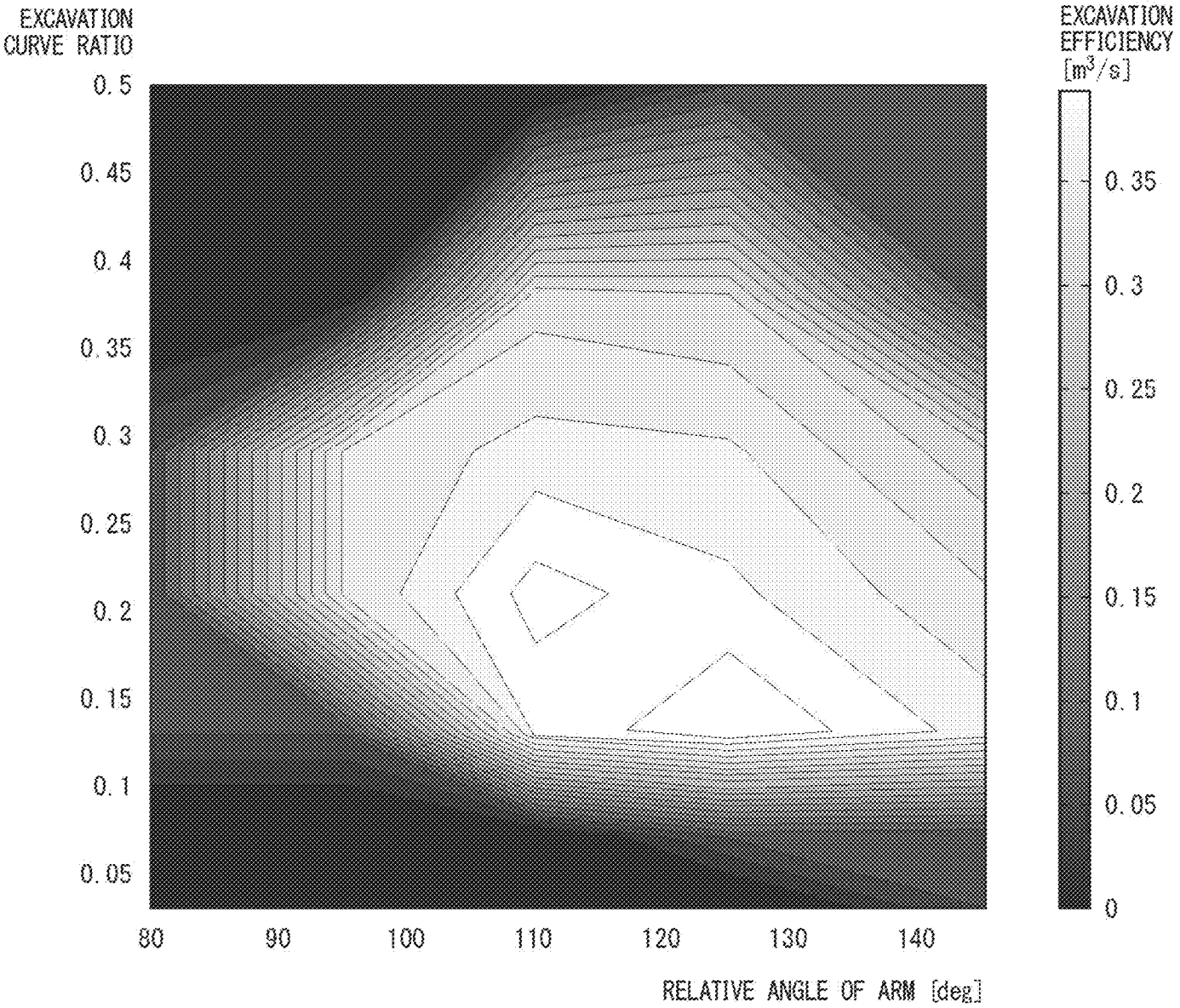
FIG. 5 is a heat map illustrating a relationship between the excavation curve ratio and the excavation efficiency.

FIG. 5 is a heat map illustrating a relationship between the excavation curve ratio and the excavation efficiency. FIG. 5 illustrates the excavation efficiency in a case where the relative angle of the arm 132 at the start of excavation is set differently when a simulation of excavation is performed based on the physical models of the work machine and the excavation target. As the relative angle of the arm 132 is larger, the distance from the swing body 120 to the teeth of the bucket 133 becomes longer. The simulation illustrated in FIG. 5 is performed based on the assumption that a certain amount of earth is excavated under the condition that the excavation target is earth distributed in a planar shape.

As illustrated in FIG. 5, the excavation efficiency changes depending on the relative angle of the arm 132 at the start of excavation. For example, as illustrated in FIG. 5, when the relative angle of the arm 132 at the start of excavation is less than 90 degrees, the excavation efficiency decreases. The loading machine 100 is designed such that the maximum force can be exerted when the relative angle of the arm 132 is approximately 90 degrees. For this reason, when the relative angle of the arm 132 at the start of excavation is less than 90 degrees, the relative angle of the arm 132 is further reduced as the excavation progresses, so that force cannot be properly exerted during excavation and the excavation speed slows down. In addition, as illustrated in FIG. 5, in a case where the relative angle of the arm 132 at the start of excavation is larger than 140 degrees, when the excavation curve ratio is larger than 0.3, the excavation efficiency decreases. The reason is that when the relative angle of the arm 132 at the start of excavation is excessively large, the posture of the arm 132 at a relative angle of approximately 90 degrees where the arm 132 exerts the maximum force cannot be sufficiently utilized, and the load applied to the work equipment 130 is increased, so that the hydraulic pressure reaches the relief pressure early.

Referring to FIG. 5, when the excavation curve ratio is from 0.12 to 0.30, stable excavation efficiency can be realized regardless of the relative angle of the arm 132 at the start of excavation. Namely, when the excavation curve ratio is from 0.12 to 0.30, the rate of change in excavation efficiency with respect to the excavation curve ratio is low.

(Operation)

When the teeth of the bucket 133 is moved to the excavation start position, the operator of the loading machine 100 turns on the switch for the automatic excavation control of the operation device 123. Accordingly, the operation device 123 generates and outputs the automatic excavation instruction signal. The excavation start position is a position on the surface of the excavation target.

Figure 6:
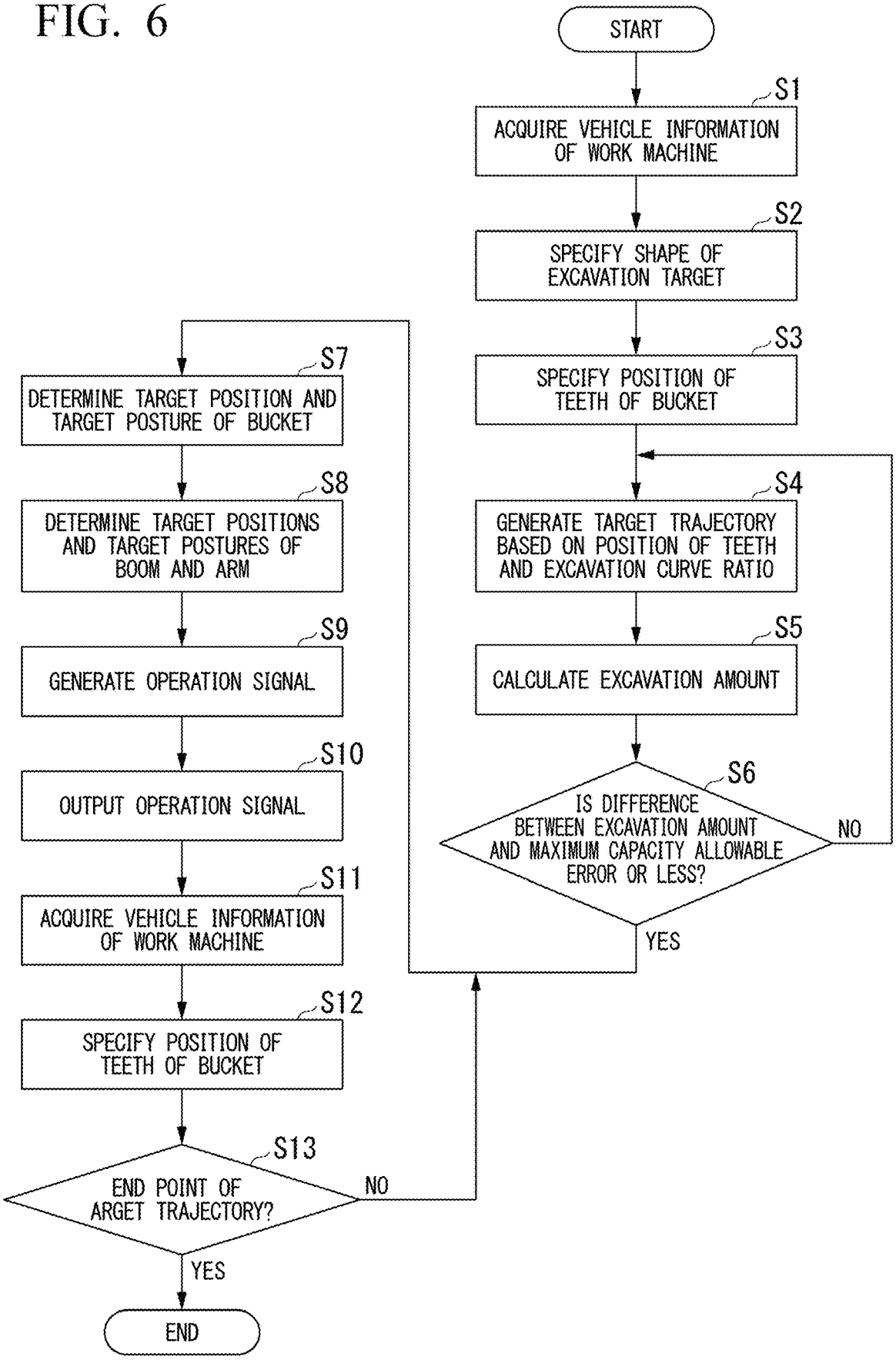
FIG. 6 is a flowchart illustrating an automatic excavation control method according to the first embodiment.

FIG. 6 is a flowchart illustrating an automatic excavation control method according to the first embodiment. When the control device 128 receives an input of the automatic excavation instruction signal from the operator, the control device 128 executes the automatic excavation control illustrated in FIG. 6.

The vehicle information acquisition unit 1101 acquires the position and azimuth direction of the swing body 120, the inclination angles of the boom 131, the arm 132, and the bucket 133, and the posture of the swing body 120 (step S1). The detection information acquisition unit 1102 acquires three-dimensional position information from the detection device 124 to specify the shape (land shape) of the excavation target from the three-dimensional position information (step S2). The bucket position specifying unit 1104 specifies the position of the teeth of the bucket 133 at the time of input of the automatic excavation instruction signal based on the vehicle information acquired by the vehicle information acquisition unit 1101 (step S3).

The trajectory generation unit 1105 generates the target trajectory T which passes through the position of the teeth specified in step S3 and has an excavation curve ratio of 0.2 (step S4). The trajectory generation unit 1105 calculates an excavation amount when excavation is performed, according to the target trajectory T generated, based on the shape of the excavation target specified by the detection information acquisition unit 1102 (step S5). For example, the trajectory generation unit 1105 specifies the cross-sectional shape of the excavation target in a drive plane of the work equipment 130 and calculates an area of a portion of the cross-sectional shape, the portion being located above the target trajectory T, to obtain the excavation amount.

The trajectory generation unit 1105 determines whether or not a difference between the calculated excavation amount and the maximum capacity of the bucket 133 is an allowable error or less (step S6). When the difference between the calculated excavation amount and the maximum capacity of the bucket 133 exceeds the allowable error (step S6: NO), the trajectory generation unit 1105 returns to step S4 to make the radius of the circular arc different and to then generate the target trajectory T. For example, when the calculated excavation amount exceeds the maximum capacity, the trajectory generation unit 1105 reduces the radius of the circular arc. For example, when the calculated excavation amount is less than the maximum capacity, the trajectory generation unit 1105 increases the radius of the circular arc. The initial value of the radius of the circular arc of the target trajectory T generated by the trajectory generation unit 1105 may be a radius when the excavation amount is equal to the maximum capacity in a case where the excavation target is flat ground.

When the difference between the excavation amount calculated in step S5 and the maximum capacity of the bucket 133 is the allowable error or less (step S6: YES), the movement processing unit 1106 determines the target position of the teeth of the bucket 133 and the target posture of the bucket 133 based on the target trajectory T and the position of the teeth of the bucket 133 (step S7). For example, the movement processing unit 1106 determines a point on the target trajectory T, the point being separated from the current position of the teeth by a distance by which the bucket 133 is movable during time interval related to a control cycle, as the target position of the teeth. In addition, the movement processing unit 1106 determines a posture, which is inclined by a predetermined angle with respect to the tangent line of the target position of the teeth, as the target posture of the bucket 133. The target posture of the bucket 133 is inclined with respect to the tangent line of the target trajectory T, so that the bottom surface of the bucket 133 can be prevented from interfering with the target trajectory T.

The movement processing unit 1106 determines the target positions and target postures of the boom 131 and the arm 132 based on the target position of the teeth and the target posture of the bucket 133 (step S8). For example, the movement processing unit 1106 can specify the position of the distal end portion of the boom 131, namely, the position of the proximal end portion of the arm 132 to move the teeth of the bucket 133 to the target position, from a relationship between the position of the proximal end portion of the bucket 133 specified from the target position of the teeth and the target posture of the bucket 133 and the known position of the proximal end portion of the boom 131.

The movement processing unit 1106 generates an operation signal based on the specified target positions and target postures of the boom 131, the arm 132, and the bucket 133 (step S9). The operation signal output unit 1107 outputs the operation signal, which is generated by the movement processing unit 1106, to the hydraulic device 127 (step S10). Accordingly, the work equipment 130 moves along the target trajectory T.

After the time related to the control cycle has elapsed, the vehicle information acquisition unit 1101 acquires the position and azimuth direction of the swing body 120, the inclination angles of the boom 131, the arm 132, and the bucket 133, and the posture of the swing body 120 (step S11). The bucket position specifying unit 1104 specifies the position of the teeth of the bucket 133 based on the acquired inclination angles of the boom 131, the arm 132, and the bucket 133 (step S12). The movement processing unit 1106 determines whether or not the position of the teeth of the bucket 133 is located at the end point of the target trajectory T (step S13). When the position of the teeth of the bucket 133 is not located at the end point of the target trajectory T (step S13: NO), the control device 128 causes the process to return to step S7 to determine the next target position and target posture of the work equipment 130. On the other hand, when the position of the teeth of the bucket 133 is located at the end point of the target trajectory T (step S13: YES), the control device 128 ends the automatic excavation control.

As described above, the control device 128 of the loading machine 100 according to the first embodiment generates the target trajectory T of the work equipment 130 according to the excavation curve ratio determined in advance and outputs an operation signal for the work equipment 130 according to the target trajectory T generated. From the knowledge, which is obtained by the inventor, that the excavation efficiency of the work equipment 130 is determined by the excavation curve ratio, it can be seen that the control device 128 can perform the automatic excavation process with a certain excavation efficiency or more with the above configuration.

In addition, the excavation curve ratio according to the first embodiment is smaller than a ratio where the hydraulic oil used to drive the work equipment 130 is relieved. Since the excavation efficiency deteriorates as the amount of the hydraulic oil relieved is increased, the excavation curve ratio is smaller than the ratio where the hydraulic oil used to drive the work equipment 130 is relieved, so that the excavation efficiency can be prevented from deteriorating rapidly.

In addition, the excavation curve ratio according to the first embodiment is larger than a ratio where the target trajectory T is comes into contact with the work machine. When the excavation curve ratio is small and the excavation length L is long to cause the target trajectory T to come into contact with the work machine, there is a possibility that a certain amount of earth cannot be excavated.

In addition, the control device 128 according to the first embodiment specifies the target trajectory T such that the excavation amount obtained by the work equipment 130 is a predetermined amount, based on the shape of the excavation target and the excavation curve ratio. Accordingly, the control device 128 can always cause a predetermined excavation amount to be excavated with a certain excavation efficiency or more.

Other Embodiments

One embodiment has been described in detail above with reference to the drawings; however, the specific configurations are not limited to those described above, and various design changes and the like can be made.

For example, in the first embodiment, the excavation curve ratio is set to a fixed value of 0.2, but is not limited thereto. For example, the control device 128 according to another embodiment may determine the excavation curve ratio based on the predetermined map as illustrated in FIG. 5 and the relative angle of the arm 132. In addition, the excavation curve ratio according to another embodiment may not be set to 0.2. In this case, the excavation curve ratio is preferably from 0.10 to less than 0.40, and more preferably from 0.10 to less than 0.30.

In addition, the loading machine 100 according to the first embodiment is, but is not limited to, a manned vehicle operated by the operator who gets thereon. For example, the loading machine 100 according to another embodiment is a remote drive vehicle operating according to an operation signal acquired via communication from a remote operation device which the operator in a remote office operates while watching a screen of a monitor. In this case, a part of functions of the control device 128 may be provided in the remote operation device.

The control device of the work machine according to the present invention can perform the automatic excavation process with a certain excavation efficiency or more.

The invention claimed is:

1. A control device of a work machine including work equipment, the control device comprising:

a controller including a processor, the controller being configured to generate a target trajectory of the work equipment according to an excavation curve ratio determined in advance, the excavation curve ratio being expressed as a ratio of an excavation depth to an excavation length, and control the work equipment according to the target trajectory.

2. The control device according to claim 1, wherein the excavation curve ratio is smaller than a ratio at which a hydraulic oil used to drive the work equipment is relieved.

3. The control device according to claim 1, wherein the excavation curve ratio is larger than a ratio at which the target trajectory comes into contact with the work machine.

4. The control device according to claim 1, wherein the excavation curve ratio is from 0.10 to less than 0.40.

5. The control device according to claim 4, wherein the excavation curve ratio is from 0.12 to less than 0.30.

6. The control device according to claim 5, wherein the excavation curve ratio is from 0.15 to less than 0.25.

7. The control device according to claim 1, the controller is further configured to acquire a shape of an excavation target from the work equipment, and generate the target trajectory such that an excavation amount of the work equipment is a predetermined amount, based on the shape of the excavation target and the excavation curve ratio.

8. A work machine comprising:

work equipment; and a controller including a processor, the controller being configured to generate a target trajectory of the work equipment according to an excavation curve ratio determined in advance, the excavation curve ratio being expressed as a ratio of an excavation depth to an excavation length, and control the work equipment according to the target trajectory.

9. A control method for a work machine including work equipment, the control method comprising using a controller including a processor to:

generate a target trajectory of the work equipment according to an excavation curve ratio determined in advance, the excavation curve ratio being expressed as a ratio of an excavation depth to an excavation length; and control the work equipment according to the target trajectory.

10. The control method according to claim 9, wherein the controlling the work equipment according to the target trajectory includes generating an operation signal to cause the work equipment to move according to the target trajectory.

11. The control method according to claim 9, wherein the controlling the work equipment according to the target trajectory includes controlling the work equipment such that teeth of a bucket of the work equipment move along the target trajectory.

12. The control device according to claim 1, wherein the controller is configured to generate an operation signal to cause the work equipment to move according to the target trajectory.

13. The control device according to claim 1, wherein the controller is configured to control the work equipment such that teeth of a bucket of the work equipment move along the target trajectory.

* * * * *